US006510592B1

(12) United States Patent
Hamilton

(10) Patent No.: US 6,510,592 B1
(45) Date of Patent: Jan. 28, 2003

(54) CLIP FOR ATTACHING POUCHES AND SIMILAR DEVICES

(75) Inventor: Jeffrey R. Hamilton, Hoffman Estates, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/686,307

(22) Filed: Oct. 11, 2000

(51) Int. Cl.[7] ..... A44B 11/02; A44B 11/25

(52) U.S. Cl. ..... 24/170; 24/191; 24/3.1

(58) Field of Search ..... 24/3.1, 3.7, 3.11, 24/3.12, 3.9, 594.1, 164–200, 311–313, 316, 323, 327, 453, 487, 543, 544, 556, 559, 560, 561, 564, 265 CD, 68 CD, 594.11, 596.1, 598.1–598.3; 132/277, 279; 224/153, 271, 272; 248/447.1; 403/83, 93, 97; 16/334, 342

(56) References Cited

U.S. PATENT DOCUMENTS

| | | | | | |
|---|---|---|---|---|---|
| 2,823,434 | A | | 2/1958 | Van Buren, Jr. | |
| 3,937,373 | A | | 2/1976 | Artz | |
| 4,038,726 | A | | 8/1977 | Takabayashi | |
| 4,083,481 | A | | 4/1978 | Selinko | |
| 4,214,686 | A | | 7/1980 | Dostourian | |
| 4,356,599 | A | * | 11/1982 | Larson et al. | 24/170 X |
| 4,387,489 | A | * | 6/1983 | Dudek | 24/170 X |
| 4,506,408 | A | * | 3/1985 | Brown | 16/225 |
| 4,551,888 | A | * | 11/1985 | Beecher | 24/518 |
| 4,604,772 | A | * | 8/1986 | Arff | 24/170 X |
| 4,733,440 | A | * | 3/1988 | Ogawa | 24/170 |
| 4,815,175 | A | | 3/1989 | Kasai | |
| 4,881,707 | A | * | 11/1989 | Garfinkle | 248/221.4 |
| 4,974,289 | A | * | 12/1990 | Piard | 16/228 |
| 5,005,220 | A | * | 4/1991 | Gaiatto et al. | 24/265 BC X |
| 5,201,099 | A | | 4/1993 | Campbell | |
| 5,499,429 | A | | 3/1996 | Higginbotham | |
| 5,604,958 | A | | 2/1997 | Anscher | |
| 5,666,982 | A | * | 9/1997 | Pignon | 132/302 |
| 5,740,591 | A | * | 4/1998 | Hopkins | 24/302 |
| 5,893,199 | A | * | 4/1999 | Anscher et al. | 24/170 X |
| 5,901,937 | A | * | 5/1999 | Compeau et al. | 248/447.1 X |
| 5,950,281 | A | * | 9/1999 | Lu | 16/342 |
| 6,145,169 | A | * | 11/2000 | Terzuola et al. | 24/170 |
| 6,185,794 | B1 | * | 2/2001 | Maggi | 24/170 |
| 6,263,543 | B1 | * | 7/2001 | Daoud | 16/342 |

* cited by examiner

*Primary Examiner*—Robert J. Sandy
*Assistant Examiner*—Ruth C. Rodriguez
(74) *Attorney, Agent, or Firm*—Mark C. Croll; Paul F. Donovan

(57) ABSTRACT

The clip includes a base hingeably attached to a lid. The lid includes two detent prongs with detent apertures including ledges formed at the distal ends thereof. These ledges engage complementary inverted ledges on detent protrusions on the base. The lid can be released from the base by squeezing the detent prongs toward each other in a direction parallel to the rotational axis between the lid and base thereby releasing the ledges from the inverted ledges. Typically, the base is secured to a first strap which can be further secured to a pouch. A second strap which is typically formed as loops on a backpack or similar structure is then secured between the lid and base in the locked position, thereby allowing a pouch to be securely attached to a backpack.

13 Claims, 8 Drawing Sheets

CLIP FOR ATTACHING POUCHES AND SIMILAR DEVICES

BACKGROUND OF THE INVENTION

1. Field of the Invention

The present invention pertains to a clip for attaching pouches to a strap, typically on a larger device, for example, a backpack, or any of many similar devices.

2. Description of the Prior Art

In the prior art, it is known to use a clip to couple an object such as a pouch or similar device to a backpack or similar device. Such a clip is disclosed in U.S. Pat. No. 5,604,958 entitled "Attachment System for Backpacks, Vests, Belts and the Like" issued on Feb. 25, 1997 to Anscher. However, this reference discloses a mating system with a key-like structure which is inconvenient to use and requires the mating plastic pieces to remain with the pack when the attachment is detached, thereby resulting in a pack surface which is cluttered in appearance. Additionally, the twisting motion required for coupling of the two pieces may make this device unsuitable for stabilizing larger devices which should be attached at several points rather than a single point. Other kinds of clips, strap fasteners and similar devices are disclosed in U.S. Pat. No. 5,201,099 entitled "Seat Belt Adjuster", issued on Apr. 13, 1993 to Campbell; U.S. Pat. No. 4,815,175 entitled "Strap Fastener", issued on Mar. 28, 1989 to Kasai; U.S. Pat. No. 4,214,686 entitled "Keeper for Load Carrying Equipment", issued on Jul. 29, 1980 to Dostourian; and U.S. Pat. No. 4,038,726 entitled "Plastic Adjuster for a Belt", issued on Aug. 2, 1977 to Takabayashi.

Other prior art references, including those for attaching a device to a user's belt, include U.S. Pat. No. 5,499,429 entitled "Pager Clip Having Aperture for Fastening to an External Article" issued on Mar. 19, 1996 to Higginbotham; U.S. Pat. No. 4,083,481 entitled "Detachable Mounting Clip Arrangement for Miniature Portable Apparatus or the Like", issued on Apr. 11, 1978 to Selinko; U.S. Pat. No. 3,937,373 entitled "Article Carrier with Improved Combination Belt Loop and Clip", issued on Feb. 10, 1976 to Artz; and U.S. Pat. No. 2,823,434 entitled "Fastening Device", issued on Feb. 18, 1958 to Van Buren, Jr.

However, these references do not appear to allow the user to hold the clip at a number of opening position while attaching a pouch to a backpack, and further may be somewhat inconvenient to use in that they do not satisfactorily combine a secure locked position with a simple way for the user to release a pouch from a backpack.

OBJECTS AND SUMMARY OF THE INVENTION

It is therefore an object of the present invention to provide a clip, such as is used to attach a pouch to a backpack, which does not require plastic mating pieces to remain attached to the backpack after the pouch is removed.

It is therefore a further object of the present invention to provide a clip, such as is used to attach a pouch to a backpack, which can be used at several places of a particularly large or heavy pouch in order to stabilize the same.

It is therefore a still further object of the present invention to provide a clip, such as is used to attach a pouch to a backpack, which is securely affixed while in a locked position, but can be easily unlocked by the user.

It is therefore a still further object of the present invention to provide a clip, such as is used to attach a pouch to a backpack, which can be held at one of several open positions while attaching the pouch to the backpack.

These and other objects are attained by clip with a base hingeably connected to a lid. The base includes slots through which the strap of a pouch passes and further includes detent protrusions. The lid includes two detent prongs with apertures through which the detent protrusions pass in the closed position. In the closed position, the clip typically engages a web strap or similar item on the exterior of the backpack in order to secure the pouch to the backpack. This results in ease of assembly to both the pouch and the pack in that once the clip is threaded the strap, the user simply pushes down on the pouch and the clip engages to the base. This further results in and a simplified two-piece assembly. In order to release the detent prongs of the lid from the detent protrusions of the base, the user squeezes the prongs together in a direction parallel to the axis of rotation of the hinge between the base and the lid. This motion releases the detent protrusions from the apertures of the detent prongs. The resulting configuration results in a secure attachment, but one which can be easily released by the user. Further, this configuration can be used at multiple locations to stabilize a single heavy pouch or similar configuration.

DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
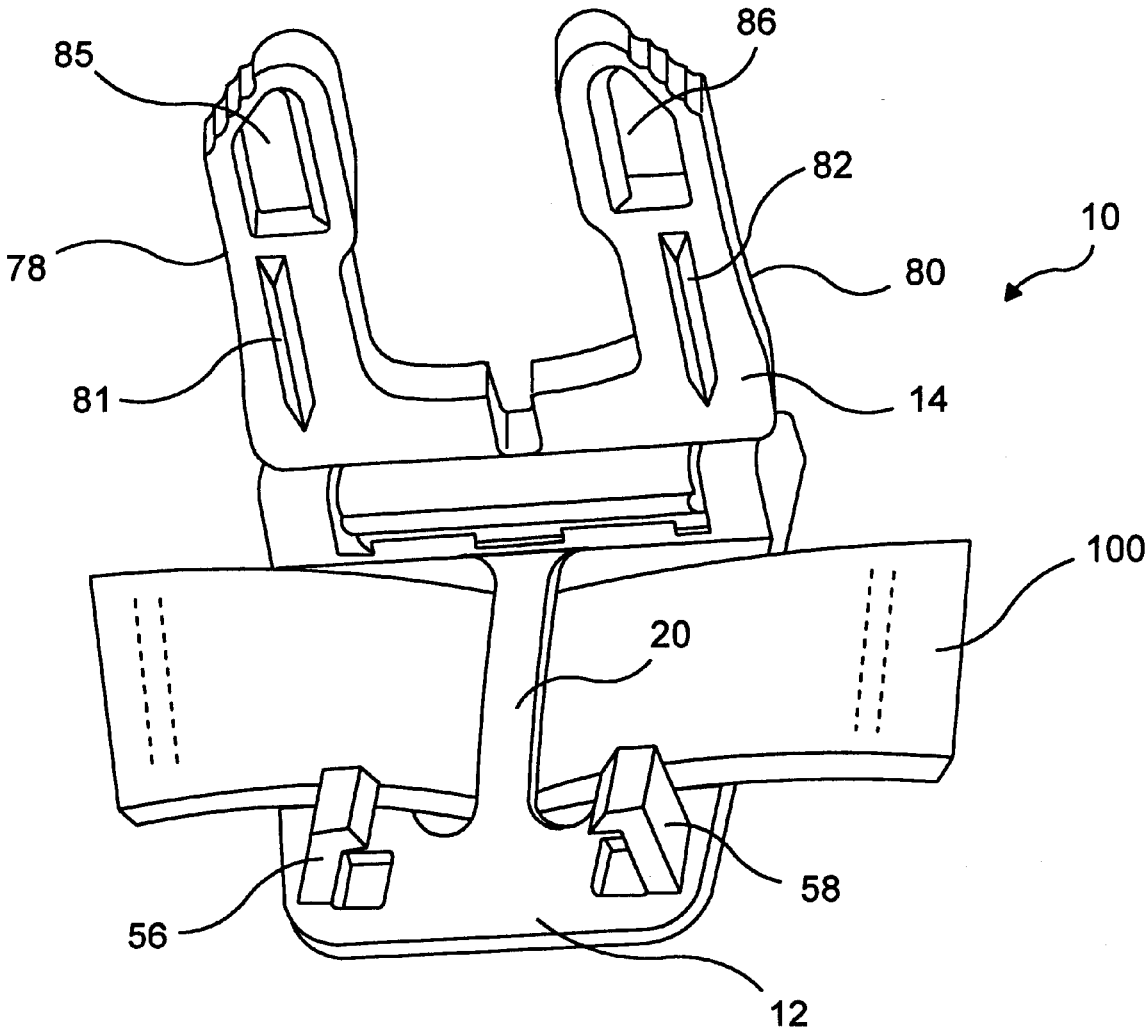
FIG. 1 is a perspective view of the clip of the present invention, shown in the open position, with the base engaging a strap, such as is attached to a pouch.
Figure 2:
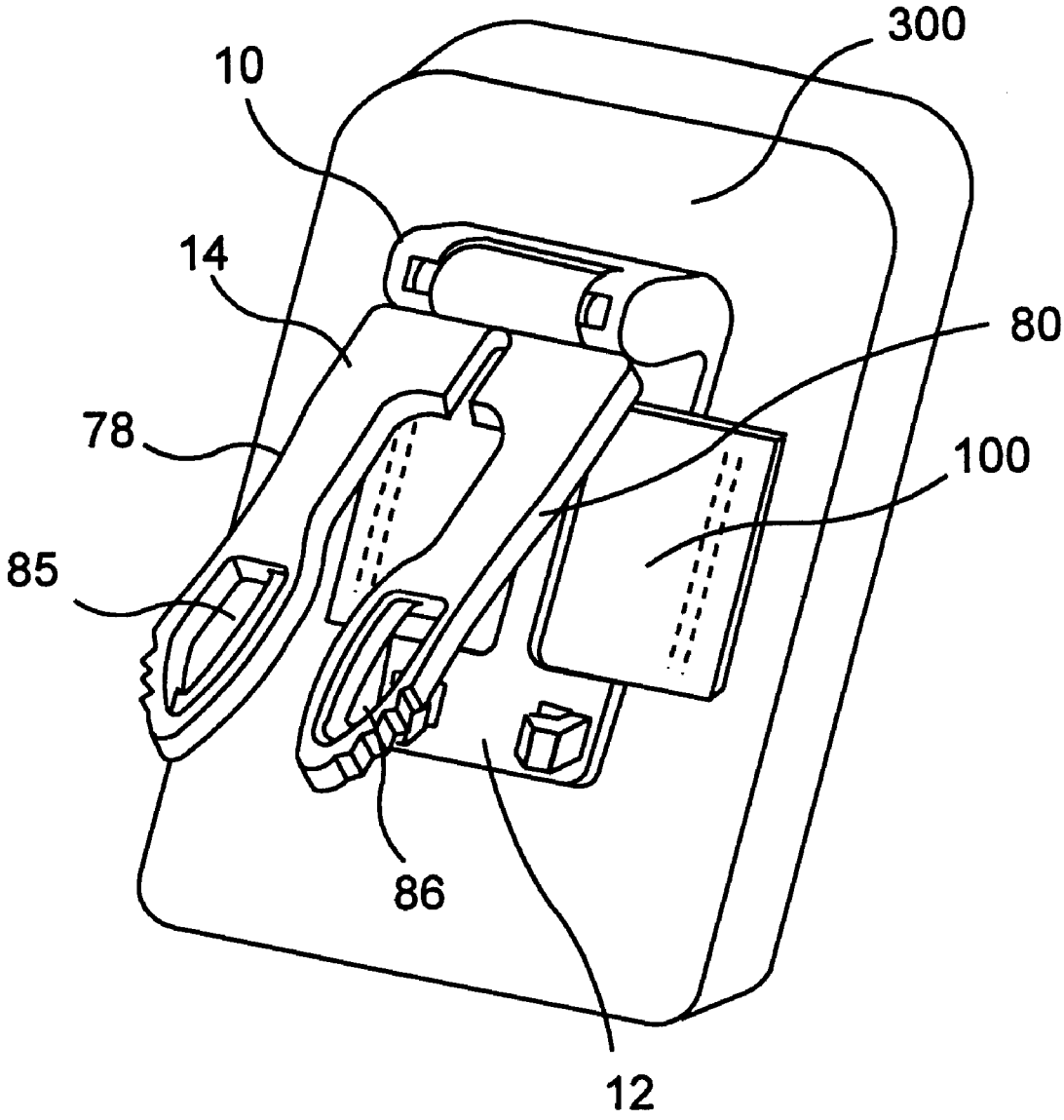
FIG. 2 is a perspective view of the clip of the present invention, shown in the partially open position, with the base engaging a strap, such as is attached to a pouch.

Referring now to the drawings in detail wherein like numerals refer to like elements throughout the several views, one sees that FIG. 1 is a perspective view of clip 10 in an open position. Clip 10 includes base 12 and lid 14, shown in more detail in FIGS. 5 and 6 respectively, which are typically formed from molded plastic, although those skilled in the art may recognize that various alternative materials may be used.

Figure 3:
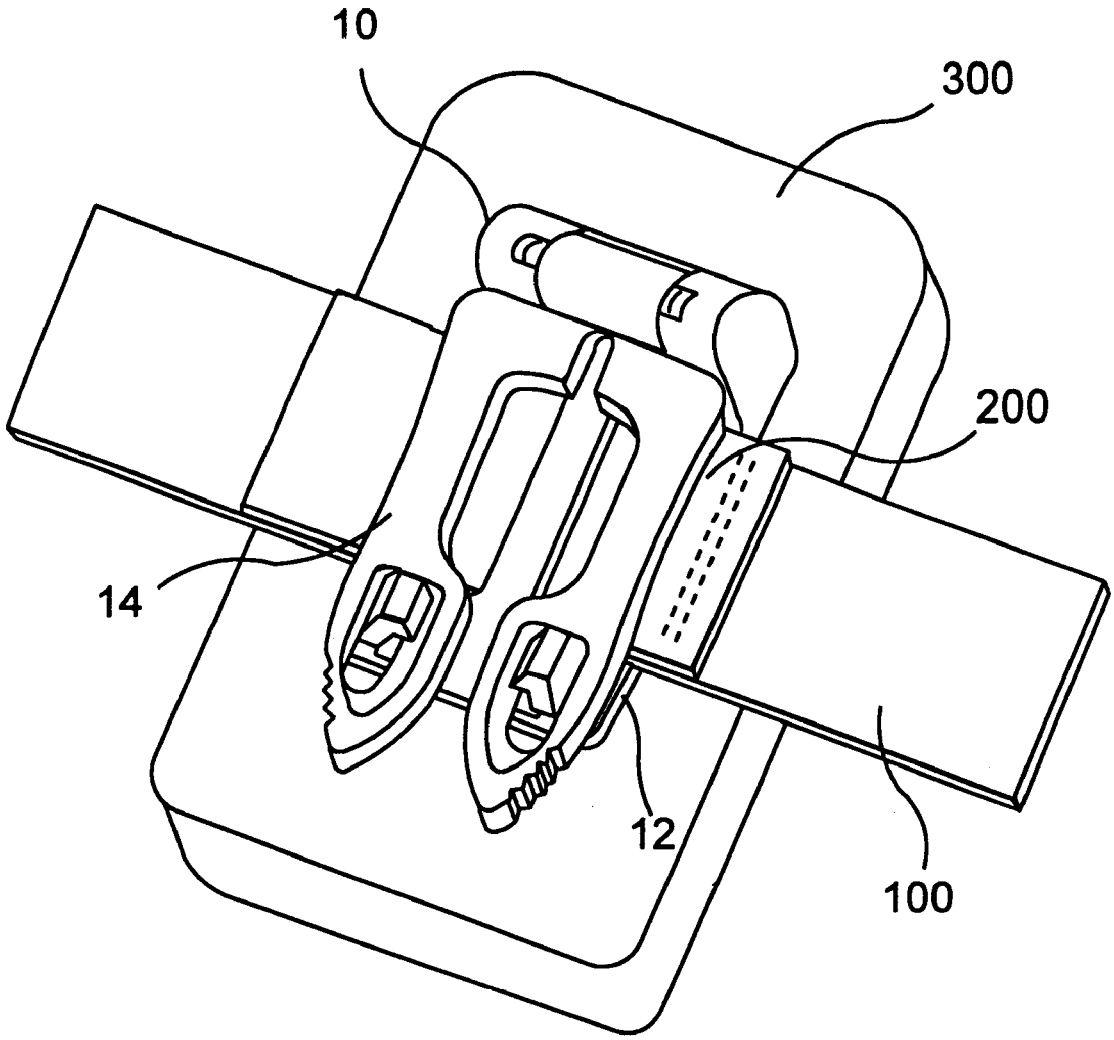
FIG. 3 is a perspective view of the clip of the present invention, shown in the closed and locked position, with the base engaging a first strap, such as is attached to a pouch, and a second strap, such as is attached to a backpack, engaged between the base and the lid.
Figure 4:
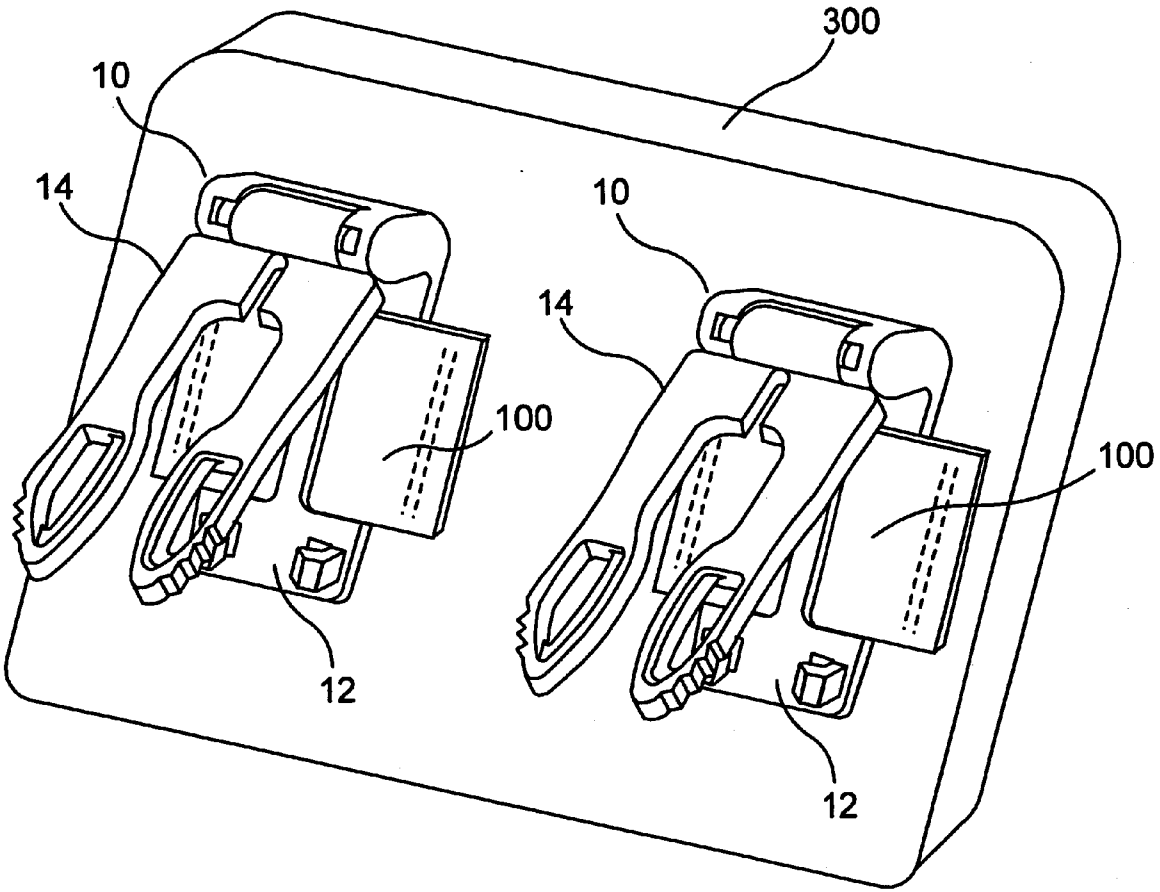
FIG. 4 is a perspective view of two clips of the present invention attached to a pouch.
Figure 8:
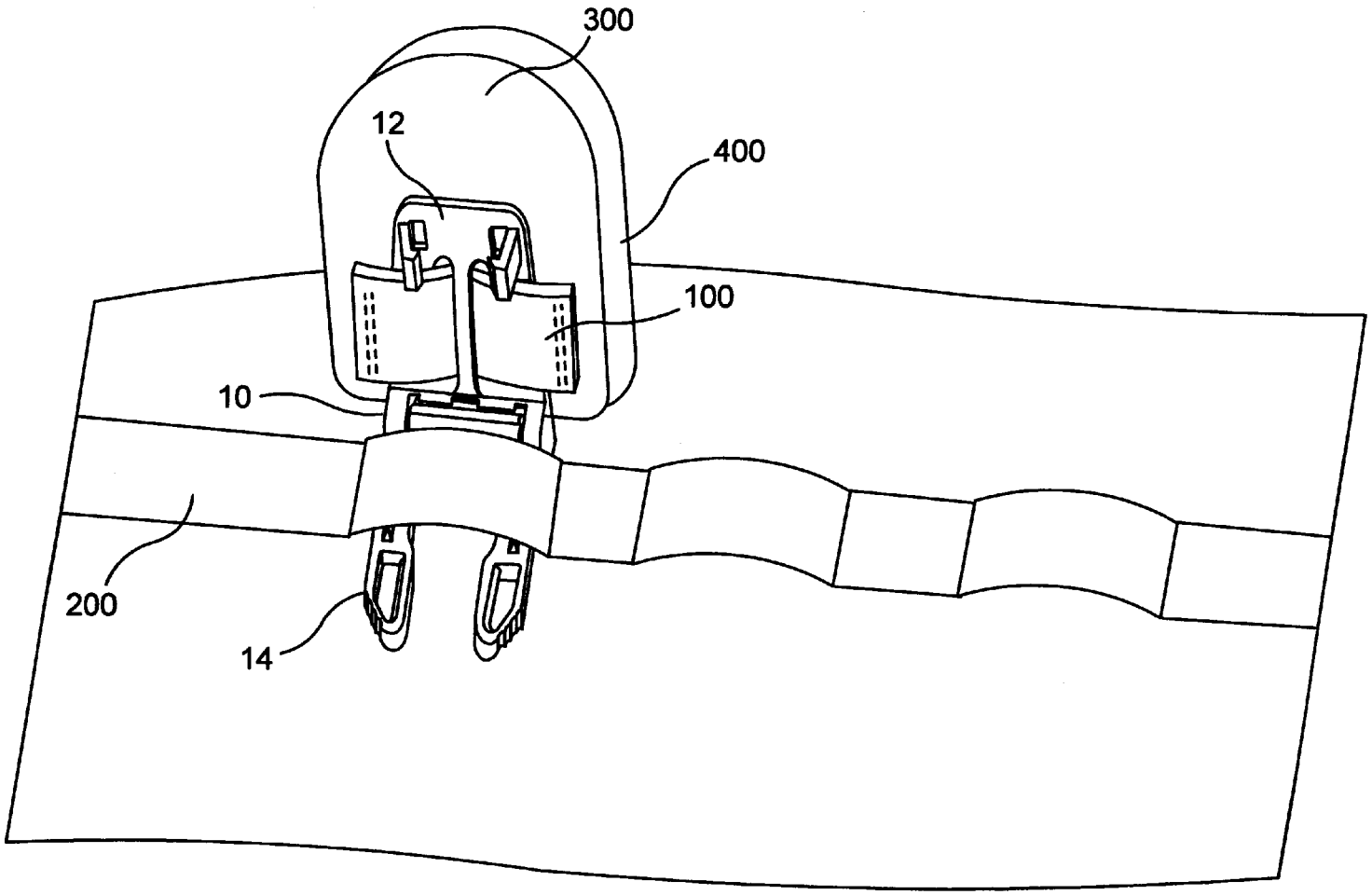
FIG. 8 is a perspective view of the clip of the present invention, in the open position, prior to engaging a pouch to a backpack.

Base 12 is generally formed on planar surface 13 with two parallel slots 16, 18 for receiving pouch strap 100 which is sewed or otherwise secured to pouch 300 as shown in FIGS. 3, 4 and 8. Bar 20 is formed between parallel slots 16, 18. While parallel slots 16, 18 are shown as not being in communication with each other, it is contemplated, as shown in phantom in FIG. 5, that slot 22 could join ends of parallel slots 16, 18 thereby converting bar 20 into a flexible tab. Similarly, as shown in phantom on FIG. 5, optional rivet 23 could be engaged through an aperture to attach clip 10 to pouch 300.

Journal supports 24, 26 rise from corners 28, 30 of base 12. Journal supports 24, 26 include colinear journal apertures 32, 34 forming an axis perpendicular to slots 16, 18. Moreover, journal apertures 32, 34 include lateral ramps 36, 38 in order to urge journal supports 24, 26 apart to allow corresponding rotatable axle elements of lid 12 to be engaged therein as will be described hereinafter.

Recesses 44, 46 are formed on planar surface 13 inwardly adjacent from journal supports 24, 26 thereby forming cantilevered surface 48 between recesses 44, 46. Ridge 50 rises upwardly from distal end 52 of cantilevered surface 48 (also see FIG. 7).

Figure 5:
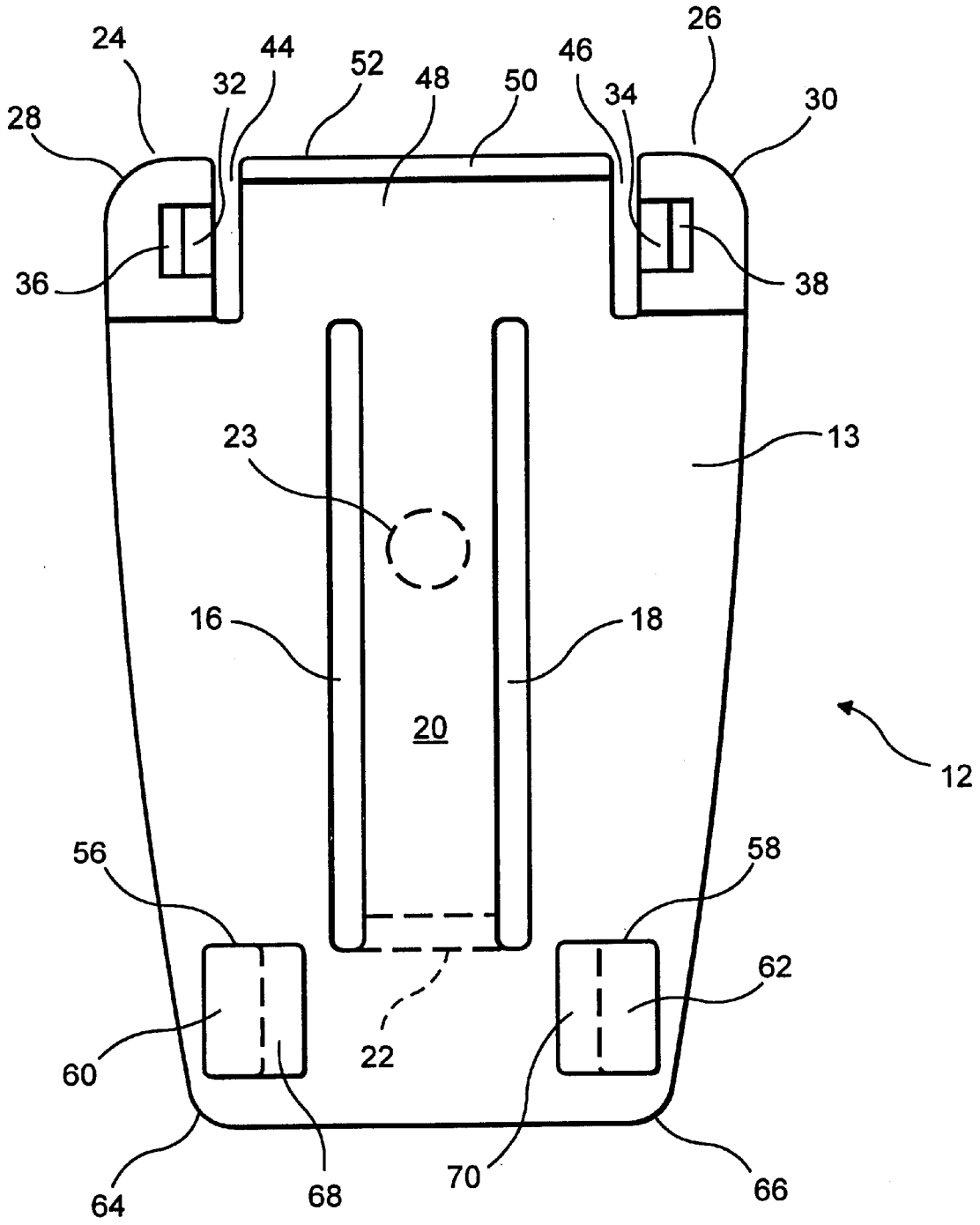
FIG. 5 is a plan view of the base of the clip of the present invention.
Figure 7:
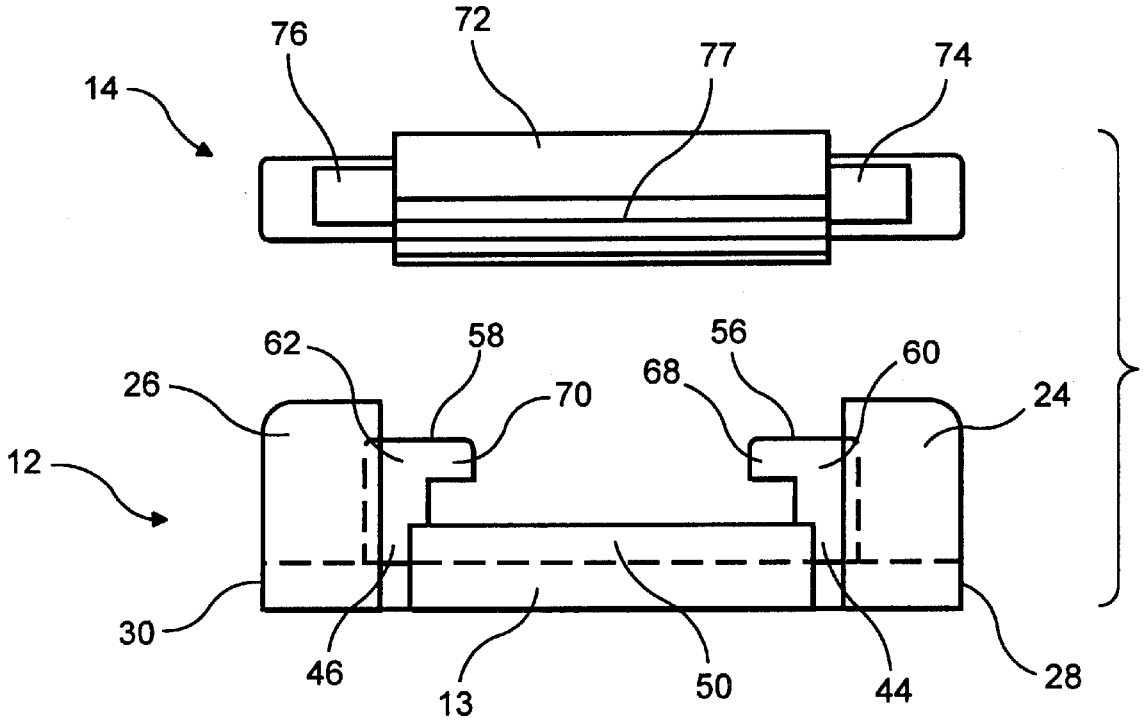
FIG. 7 is a rear exploded plan view, partially in phantom, of the base and the lid of the clip of the present invention.

Detent protrusions 56, 58 are formed from posts 60, 62 which arise from planar surface inwardly adjacent from corners 64, 66 and further include inwardly extending detent inverted ledges 68, 70 which face each other (see FIGS. 1, 5 and 7). Moreover, detent protrusions 56, 58 aid in maintaining pouch strap 100 under flexible tab 20 in the embodiment which includes slot 22.

Figure 6:
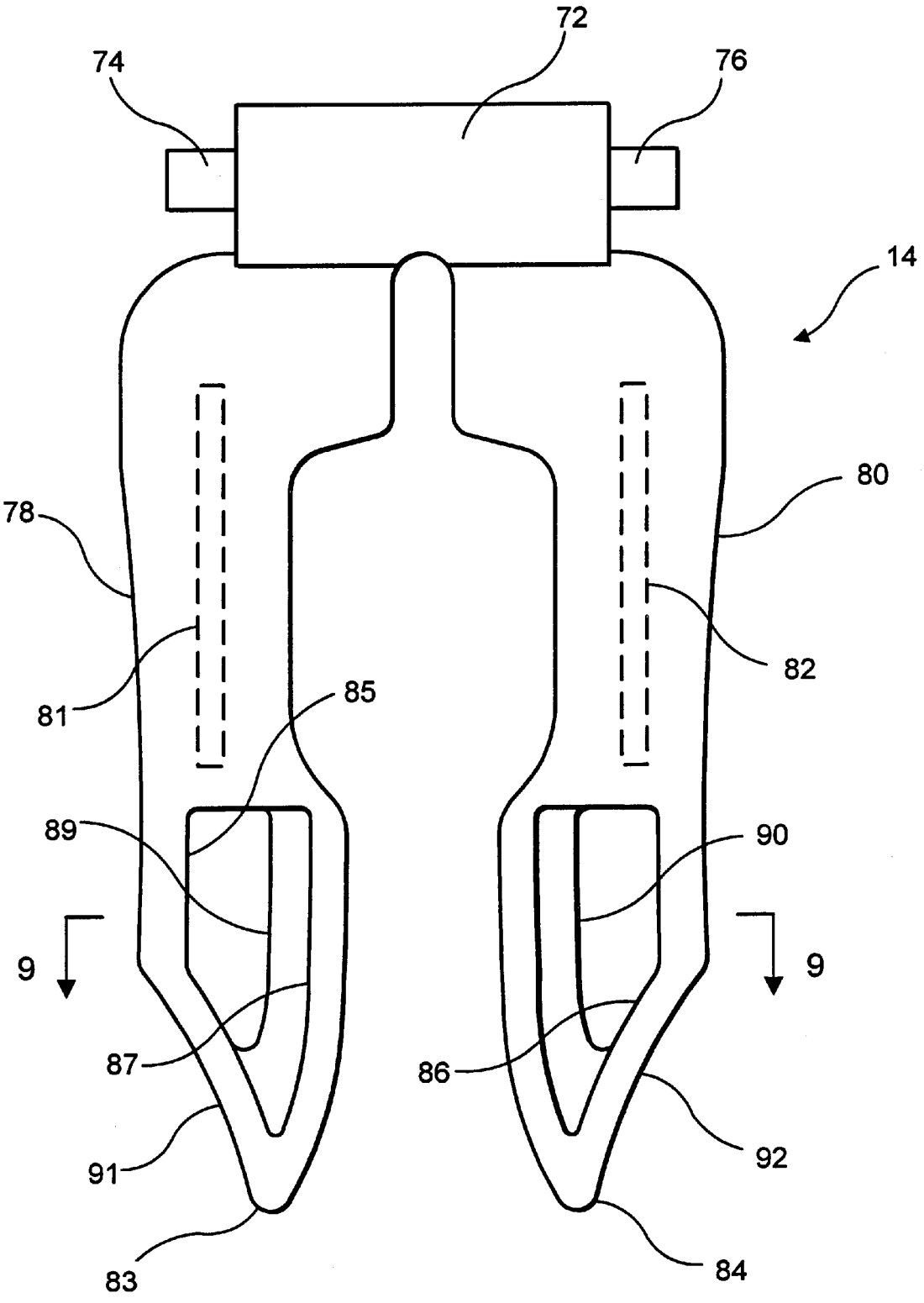
FIG. 6 is a top plan view, partially in phantom, of the lid of the clip of the present invention.

As shown in FIG. 6, lid 14 is generally planar and includes enlarged axis section 72 with colinear cylindrical axle sections 74, 76 extending laterally therefrom. Axle sections 74, 76 are engaged by colinear journal apertures 32, 34, respectively. As axle sections 74, 76 are initially urged into colinear journal apertures 32, 34, axle sections 74, 76 urge against lateral ramps 36, 38 in order to urge journal supports 24, 26 apart to allow axle sections 74, 76 to be rotatably engaged within journal apertures 32, 34.

As can be seen from FIG. 7, enlarged axis section 72 includes longitudinal striations 77 which are periodically engaged by ridge 50 of base 12 throughout the range of open positions of lid 14 with respect to base 12. In other words, lid 14 can be held open at several different angles with respect to base 12 by ridge 50 engaging the various longitudinal striations 77.

Figure 9:
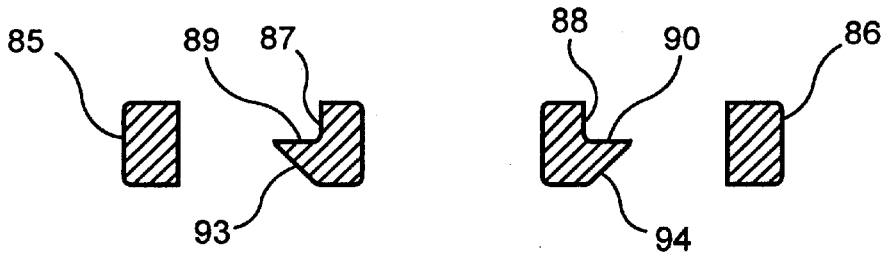
FIG. 9 is a cross-sectional view along plane 9—9 of FIG. 6.

Detent prongs 78, 80 are parallel to each other and extend radially from enlarged axis section 72. As shown in perspective in FIG. 1 and in phantom in FIG. 3, the underside of detent prongs 78, 80 includes gripping ridges 81, 82 which, in the closed position, face toward planar surface 13 of base 12 in order to provide extra gripping force against the external strap 200 attached to backpack 400 or similar external object (see FIGS. 3 and 8). Distal ends 83, 84 of detent prongs 78, 80 include detent apertures 85, 86 through which detent protrusions 56, 58 pass in the closed position (see FIG. 3). The inward surfaces 87, 88 of detent apertures 85, 86 further include detent ledges 89, 90 which detent engage inwardly extending detent inverted ledges 68, 70 in the closed position. As can be seen in FIG. 9, the underside of detent ledges 89, 90 include chamfered surfaces 93, 94 which, as lid 14 is closed against base 12, engage detent protrusions 56, 58 thereby urging detent prongs 78, 80 inwardly toward each other until inverted ledges 68, 70 clear detent ledges 89, 90 and detent prongs 78, 80 snap outwardly into detent position.

Concave gripping surfaces 91, 92 are formed on the outer surfaces of distal ends 83, 84 of detent prongs 78, 80. This allows a user to unlock lid 14 from base 12 by grasping distal ends 83, 84 between a user's thumb and forefinger and squeezing in a direction parallel to the axis of rotation formed by axle sections 74, 76. This urges detent ledges 89, 90 away from inwardly extending detent inverted ledges 68, 70 and allows lid 14 to rotate away from base 12 to a position such as is shown in FIG. 1, while maintaining the rotatable connection between axle sections 74, 76 and colinear journal apertures 32, 34.

As shown in the various figures, clip 10 is provided with base 12 secured to strap 100 which, in turn, is secured to pouch 300. If slot 22 is not formed in base 12, then typically strap 100 is laced through parallel slots 16, 18 and sewed to pouch 300. Alternatively, strap 100 can be first sewed to pouch 300, then the embodiment of base 12 including slot 22 can be slipped onto strap 100. Backpack 400 is typically formed with strap 200 sewed thereto so as to form loops (see FIG. 8). Clip 10, in the open position with base 12 secured to pouch 300, is positioned so that detent prongs 78, 80 of lid 14 extend through one of the loops in strap 200 on backpack 400. Lid 14 is then urged towards a closed position with respect to base 12 whereby detent protrusions 56, 58 extend through detent apertures 85, 86 so that inwardly extending inverted ledges 68, 70 detent engage detent ledges 89, 90 thereby engaging strap 200 between base 12 and lid 14 while strap 100 is secured to base 12. In order to release pouch 300 from backpack 400, the user squeezes detent prongs 78, 80 together with the user's thumb and forefinger so as to release the detent engagement between detent protrusions 56, 58 and detent apertures 85, 86.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A clip including:

a base section including detent elements;

a lid section hingeably connected to said base section about a rotational axis, said lid section further including a first prong and a second prong extending radially with respect to said rotational axis, said first and second prongs including respective first and second detent apertures passing through distal ends thereof for engaging said detent elements in a closed position of said lid with respect to said base;

wherein by urging said first and second prongs in a direction parallel to said rotational axis, said first and second detent apertures are released from said detent elements.

2. The clip of claim 1 wherein said base further includes slots through which a first strap can be engaged.

3. The clip of claim 2 wherein said detent elements include detent protrusions on said base.

4. The clip of claim 3 wherein distal ledges are formed adjacent to said first and second detent apertures for engaging inverted distal ledges formed in said detent protrusions.

5. The clip of claim 4 wherein chamfered surfaces are formed on undersides of said distal ledges for ramping against said detent protrusions thereby urging said first and second prongs toward each other as said lid section is rotated toward said base section.

6. The clip of claim 5 wherein said lid section includes colinear axle sections about said rotational axis and said base includes colinear journal apertures for engaging said colinear axle sections.

7. The clip of claim 6 wherein said first and second prongs include respective first and second finger gripping portions for squeezing said first and second prongs toward each other in a direction parallel to said rotational axis in order to release said detent elements from said first and second detent apertures.

8. The clip of claim 7 wherein said first and second prongs include gripping ridges on a surface facing said base in order to grip a second strap engaged between said base and said lid when said detent elements engage said first and second detent apertures.

9. The clip of claim 8 wherein said lid includes striations parallel to said rotational axis proximate to said axle sections, and wherein said base includes a ridge which urges against said striations thereby allowing said lid to be held in any of a plurality of rotational open positions with respect to said base.

10. The clip of claim 9 further including ramps proximate to said journal apertures for guiding said colinear axle sections into said journal apertures.

11. The clip of claim 10 wherein said base section includes two parallel slots for threading webbing therethrough.

12. The clip of claim 11 wherein two parallel slots are joined by a slot orthogonal thereto thereby forming a tab.

13. The clip of claim 10 wherein said base section includes an aperture for receiving a rivet for attaching the clip to webbing.

* * * * *